US011053623B2

(12) United States Patent
Davis

(10) Patent No.: US 11,053,623 B2
(45) Date of Patent: Jul. 6, 2021

(54) METHODS OF OPERATING BALANCING SYSTEMS OF WASHING MACHINE APPLIANCES WITH MOTION SENSORS

(71) Applicant: Haier US Appliance Solutions, Inc., Wilmington, DE (US)

(72) Inventor: Paul Owen Davis, Prospect, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 59 days.

(21) Appl. No.: 16/254,785

(22) Filed: Jan. 23, 2019

(65) Prior Publication Data

US 2020/0232140 A1 Jul. 23, 2020

(51) Int. Cl.

| | |
|---|---|
| ***D06F 37/02*** | (2006.01) |
| ***D06F 37/20*** | (2006.01) |
| ***D06F 23/02*** | (2006.01) |
| ***D06F 39/08*** | (2006.01) |
| ***D06F 33/00*** | (2020.01) |

(52) U.S. Cl.

CPC ..... *D06F 37/203* (2013.01); *D06F 23/02* (2013.01); *D06F 33/00* (2013.01); *D06F 39/088* (2013.01); *D06F 2202/10* (2013.01); *D06F 2204/086* (2013.01); *D06F 2212/02* (2013.01); *D06F 2222/00* (2013.01)

(58) Field of Classification Search

CPC ..... D06F 37/203

See application file for complete search history.

(56) References Cited

U.S. PATENT DOCUMENTS

| | | | | |
|---|---|---|---|---|
| 8,113,232 | B1 | 2/2012 | Tallman | |
| 8,930,031 | B2 | 1/2015 | Wong et al. | |
| 9,624,616 | B2 | 4/2017 | Kim et al. | |
| 10,000,875 | B2 | 6/2018 | Davis et al. | |
| 2015/0233036 | A1* | 8/2015 | Kim | D06F 37/203 68/12.06 |
| 2018/0016728 | A1 | 1/2018 | Davis | |
| 2018/0057988 | A1 | 3/2018 | Davis | |

FOREIGN PATENT DOCUMENTS

| | | | |
|---|---|---|---|
| EP | 2025797 | B1 | 10/2012 |
| EP | 2572027 | B1 | 8/2015 |
| WO | WO2016180371 | A1 | 11/2016 |

* cited by examiner

*Primary Examiner* — Jason Y Ko

(74) *Attorney, Agent, or Firm* — Dority & Manning, P.A.

(57) ABSTRACT

A washing machine appliance and related methods are provided. The washing machine appliance has a wash tub, a wash basket rotatably mounted within the wash tub, and a balancing system comprising a plurality of fluid chambers defined in the wash basket. The method includes rotating the wash basket within the wash tub at a basket speed. The method also includes receiving, with the balancing system, a first signal from a measurement device and receiving, with the balancing system, a second signal from a controller of the washing machine appliance. The method further includes opening a valve to provide fluid to at least one of the plurality of fluid chambers of the balancing system based on the first signal and the second signal.

16 Claims, 12 Drawing Sheets

METHODS OF OPERATING BALANCING SYSTEMS OF WASHING MACHINE APPLIANCES WITH MOTION SENSORS

FIELD OF THE INVENTION

The present subject matter relates generally to washing machine appliances, such as horizontal axis washing machine appliances, and methods for monitoring load balances in such washing machine appliances.

BACKGROUND OF THE INVENTION

Washing machine appliances generally include a cabinet which receives a wash tub for containing water or wash fluid (e.g., water and detergent, bleach, or other wash additives). The wash tub may be suspended within the cabinet by a suspension system to allow some movement relative to the cabinet during operation. A basket is rotatably mounted within the wash tub and defines a wash chamber for receipt of articles for washing. During normal operation of such washing machine appliances, the wash fluid is directed into the wash tub and onto articles within the wash chamber of the basket. A drive assembly is coupled to the wash tub and configured to rotate the wash basket within the wash tub to agitate articles within the wash chamber, to wring wash fluid from articles within the wash chamber, etc.

A significant concern during operation of washing machine appliances is the balance of the tub. For example, articles and water loaded within a basket may not be equally weighted about a central axis of the basket and tub. Accordingly, when the basket rotates, in particular during a spin cycle, the imbalance in clothing weight may cause the basket to be out-of-balance within the tub, such that the axis of rotation does not align with the cylindrical axis of the basket or tub. Such out-of-balance issues can cause the basket to contact the tub during rotation and can further cause movement of the tub within the cabinet. Significant movement of the tub can, in turn, generate increased noise and vibrations and/or cause excessive wear and premature failure of appliance components.

Various methods are known for monitoring load balances and preventing out-of-balance scenarios within washing machine appliances. Such monitoring and prevention may be especially important, for instance, during the high-speed rotation of the wash basket, e.g., during a spin cycle. For example, conventional systems monitor motor current or rotational velocity to determine when articles within the tub are in a suitable position for a spin cycle. Alternatively, one or more balancing rings may be attached to the rotating basket to provide a rotating annular mass that minimizes the effects of imbalances. However, such systems often fail to accurately determine the position of articles within the tub or basket or detect or compensate for an out-of-balance condition. Moreover, such systems often require additional components and/or sensors, thereby increasing the cost and complexity of the appliance.

Accordingly, improved methods and apparatuses for monitoring load balance in washing machine appliances are desired. In particular, methods and apparatuses that provide for compensation for an imbalanced state during a washing operation would be advantageous.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a method for operating a washing machine appliance is provided. The washing machine appliance has a wash tub, a wash basket rotatably mounted within the wash tub, and a balancing system comprising a plurality of fluid chambers defined in the wash basket. The method includes rotating the wash basket within the wash tub at a basket speed. The method also includes receiving, with the balancing system, a first signal from a measurement device and receiving, with the balancing system, a second signal from a controller of the washing machine appliance. The method further includes opening a valve to provide fluid to at least one of the plurality of fluid chambers of the balancing system based on the first signal and the second signal.

In another exemplary aspect of the present disclosure, a washing machine appliance is provided including a cabinet and a wash tub positioned within the cabinet. The washing machine appliance also includes a measurement device configured for sending a first signal to a balancing system of the washing machine appliance. The washing machine appliance further includes a controller. The controller is configured for rotating the wash basket within the wash tub at a basket speed and sending a second signal to the balancing system of the washing machine appliance. The balancing system is configured for opening a valve to provide fluid to at least one of a plurality of fluid chambers of the balancing system based on the first signal and the second signal.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
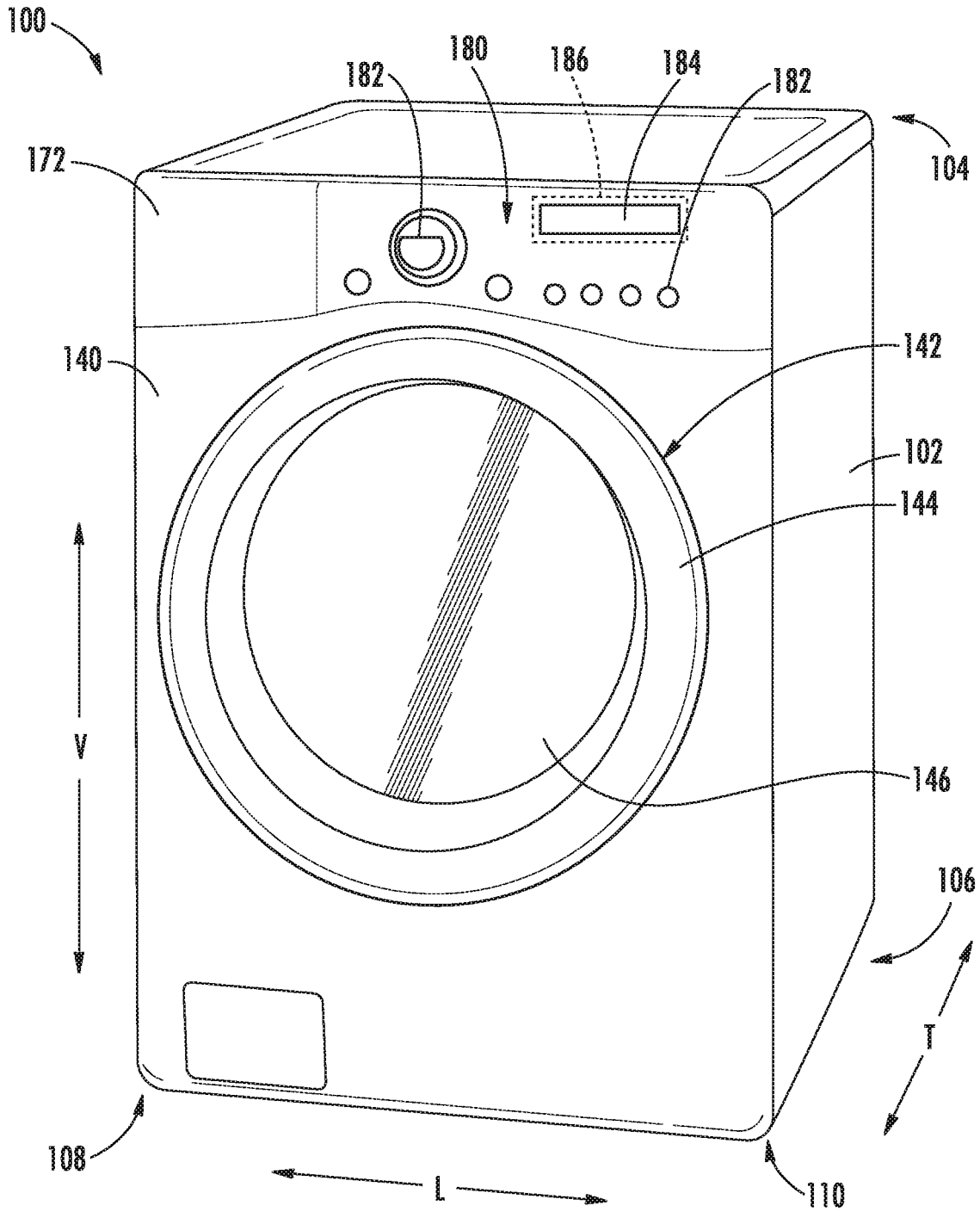
FIG. 1 provides a perspective view of a washing machine appliance according to exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In order to aid understanding of this disclosure, several terms are defined below. The defined terms are understood to have meanings commonly recognized by persons of ordinary skill in the arts relevant to the present invention. The terms "includes" and "including" are intended to be inclusive in a manner similar to the term "comprising." Similarly, the term "or" is generally intended to be inclusive (i.e., "A or B" is intended to mean "A or B or both"). The terms "first," "second," and "third" may be used interchangeably to distinguish one element from another and are not intended to signify location or importance of the individual elements. Furthermore, it should be appreciated that as used herein, terms of approximation, such as "approximately," "substantially," or "about," refer to being within a ten percent margin of error.

Figure 2:
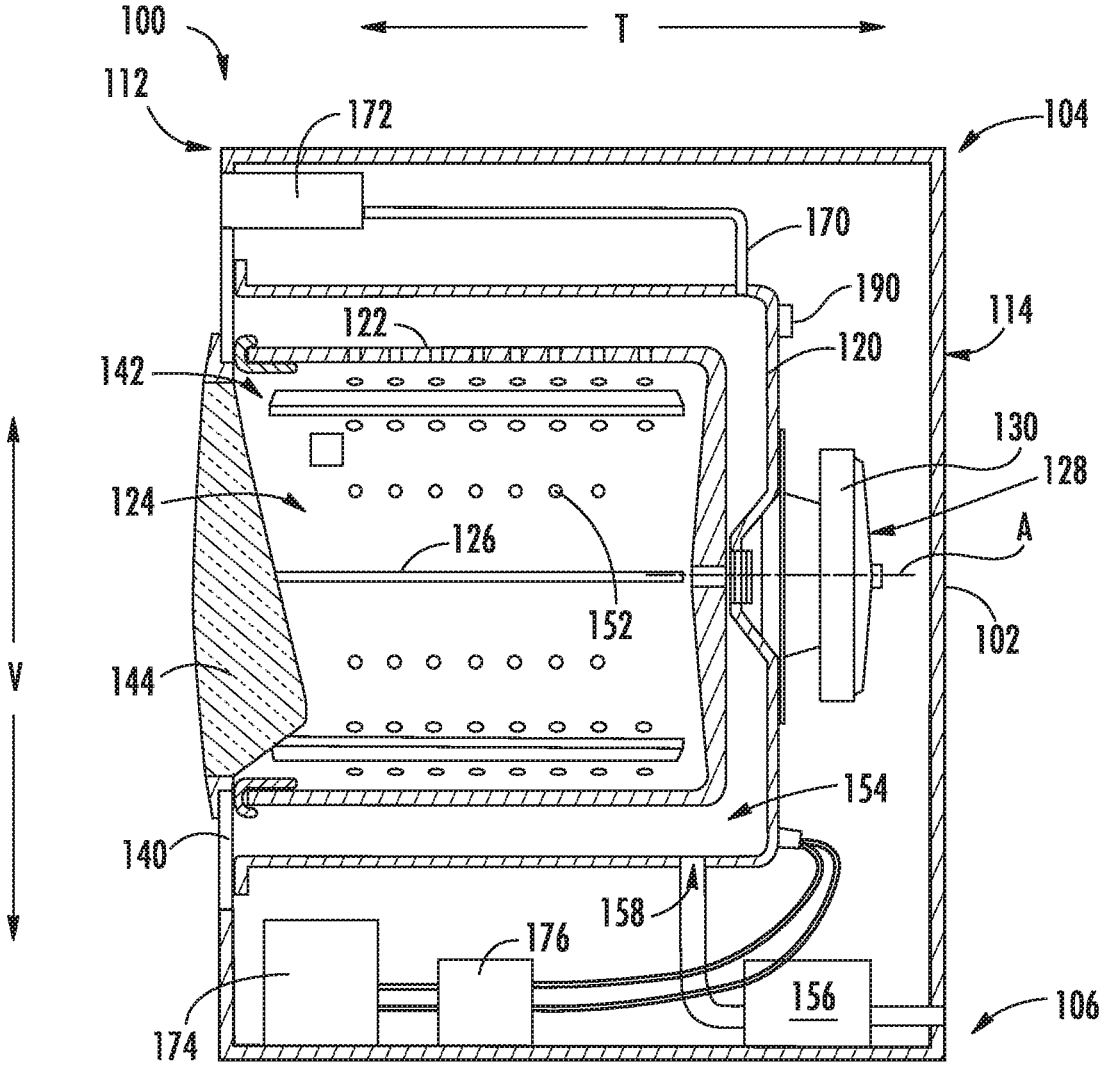
FIG. 2 provides a cross-sectional side view of the exemplary washing machine appliance.

Referring now to the figures, FIG. 1 is a perspective view of an exemplary horizontal axis washing machine appliance 100 and FIG. 2 is a side cross-sectional view of washing machine appliance 100. As illustrated, washing machine appliance 100 generally defines a vertical direction V, a lateral direction L, and a transverse direction T, each of which is mutually perpendicular, such that an orthogonal coordinate system is generally defined. Washing machine appliance 100 includes a cabinet 102 that extends between a top 104 and a bottom 106 along the vertical direction V, between a left side 108 and a right side 110 along the lateral direction, and between a front 112 and a rear 114 along the transverse direction T.

Referring to FIG. 2, a wash tub 120 is positioned within cabinet 102 and is generally configured for retaining wash fluids during an operating cycle. As used herein, "wash fluid" may refer to water, detergent, fabric softener, bleach, or any other suitable wash additive or combination thereof. A wash basket 122 is received within wash tub 120 and defines a wash chamber 124 that is configured for receipt of articles for washing. More specifically, wash basket 122 is rotatably mounted within wash tub 120 such that it is rotatable about an axis of rotation A. According to the illustrated embodiment, the axis of rotation is substantially parallel to the transverse direction T. In this regard, washing machine appliance 100 is generally referred to as a "horizontal axis" or "front load" washing machine appliance 100. However, it should be appreciated that aspects of the present subject matter may be used within the context of a vertical axis or top load washing machine appliance as well.

Wash basket 122 may define one or more agitator features that extend into wash chamber 124 to assist in agitation and cleaning articles disposed within wash chamber 124 during operation of washing machine appliance 100. For example, as illustrated in FIG. 2, a plurality of ribs 126 extends from basket 122 into wash chamber 124. In this manner, for example, ribs 126 may lift articles disposed in wash basket 122 during rotation of wash basket 122.

Figure 4:
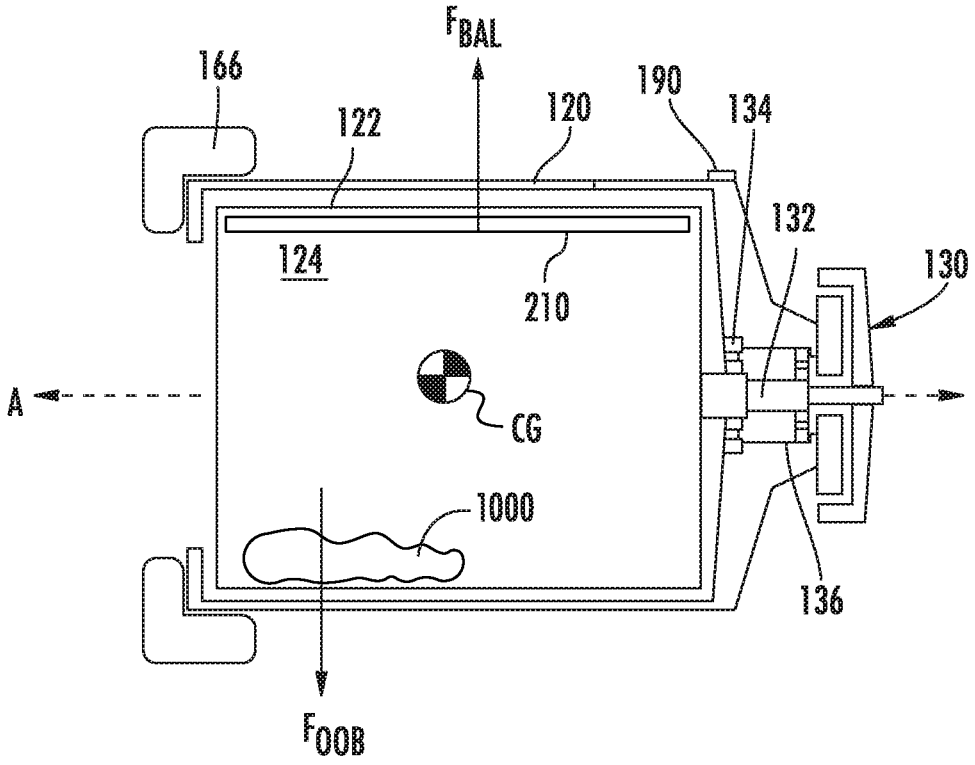
FIG. 4 provides a schematic side view of components of a washing machine appliance in accordance with exemplary embodiments of the present disclosure.

Washing machine appliance 100 includes a drive assembly 128 which is coupled to wash tub 120 and is generally configured for rotating wash basket 122 during operation, e.g., such as during an agitation or spin cycle. More specifically, as best illustrated in FIGS. 2 and 4, drive assembly 128 may include a motor assembly 130 that is in mechanical communication with wash basket 122 via a drive shaft 132 to selectively rotate wash basket 122 (e.g., during an agitation or a rinse cycle of washing machine appliance 100). In addition, drive shaft 132 is principally rotatably supported by a front bearing 134 and a rear bearing 136. According to the illustrated embodiment, motor assembly 130 is a pancake motor. However, it should be appreciated that any suitable type, size, or configuration of motors may be used to rotate wash basket 122 according to alternative embodiments. In addition, drive assembly 128 may include any other suitable number, types, and configurations of support bearings or drive mechanisms.

Referring generally to FIGS. 1 and 2, cabinet 102 also includes a front panel 140 that defines an opening 142 that permits user access to wash basket 122 of wash tub 120. More specifically, washing machine appliance 100 includes a door 144 that is positioned over opening 142 and is rotatably mounted to front panel 140 (e.g., about a door axis that is substantially parallel to the vertical direction V). In this manner, door 144 permits selective access to opening 142 by being movable between an open position (not shown) facilitating access to a wash tub 120 and a closed position (FIG. 1) prohibiting access to wash tub 120.

In some embodiments, a window 146 in door 144 permits viewing of wash basket 122 when door 144 is in the closed position (e.g., during operation of washing machine appliance 100). Door 144 also includes a handle (not shown) that, for example, a user may pull when opening and closing door 144. Further, although door 144 is illustrated as mounted to front panel 140, it should be appreciated that door 144 may be mounted to another side of cabinet 102 or any other suitable support according to alternative embodiments. Additionally or alternatively, a front gasket or baffle (not shown) may extend between tub 120 and the front panel 140 about the opening 142 covered by door 144, further sealing tub 120 from cabinet 102.

Referring again to FIG. 2, wash basket 122 also defines a plurality of perforations 152 in order to facilitate fluid communication between an interior of basket 122 and wash tub 120. A sump 154 is defined by wash tub 120 at a bottom of wash tub 120 along the vertical direction V. Thus, sump 154 is configured for receipt of, and generally collects, wash fluid during operation of washing machine appliance 100. For example, during operation of washing machine appliance 100, wash fluid may be urged (e.g., by gravity) from basket 122 to sump 154 through plurality of perforations 152. A pump assembly 156 is located beneath wash tub 120 for gravity assisted flow when draining wash tub 120 (e.g., via a drain 158). Pump assembly 156 is also configured for recirculating wash fluid within wash tub 120.

Figure 3:
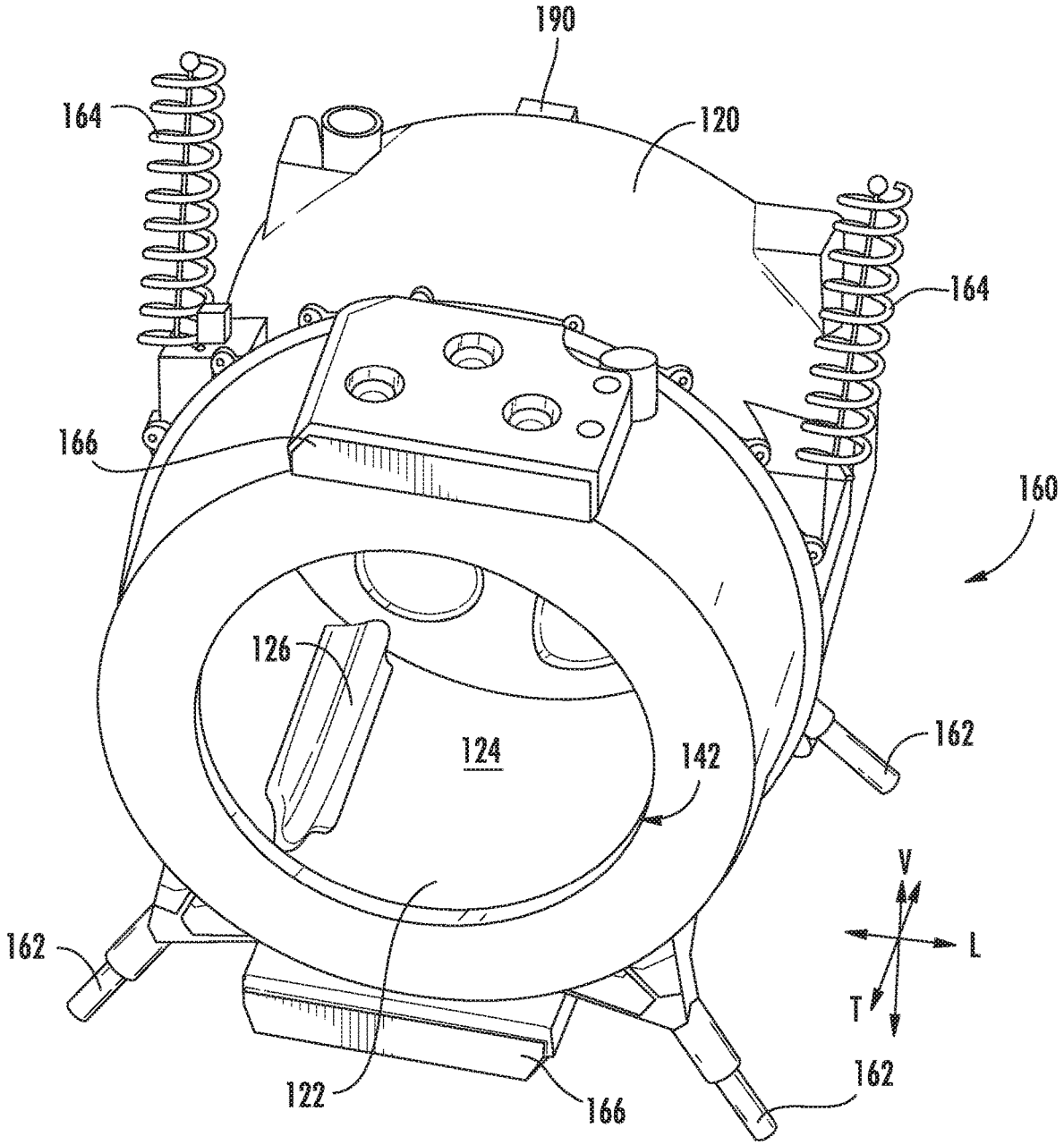
FIG. 3 provides a perspective view of a portion of the exemplary washing machine appliance, wherein the cabinet has been removed for clarity.

Turning briefly to FIG. 3, basket 122 and tub 120 are supported within cabinet 102 by a vibration damping system or suspension system 160. Suspension system 160 generally operates to damp or reduce dynamic motion and absorb vibrations resulting from the movement of wash basket 122 within the tub 120. Suspension system 160 can include one or more damper assemblies 162 coupled between and to the cabinet 102 and wash tub 120 (e.g., at a bottom portion or bottom 106 of wash tub 120). Typically, three or four damper assemblies 162 are utilized, and are spaced apart about the wash tub 120. For example, four damper assemblies 162 may be provided with each damper assembly 162 connected at one end thereof to the cabinet 102 proximate a bottom corner of the cabinet 102.

Additionally or alternatively, washing machine appliance 100 can include other vibration damping elements, such as one or more suspension springs 164. According to the illustrated embodiment, suspension system 160 includes two suspension springs 164 that extend between top 104 of cabinet 102 and sides of wash tub 120, e.g., to be fixed at a location proximate to but above a center of gravity of wash tub 120. In optional embodiments, suspension system 160 (and washing machine appliance 100, generally) is free of any annular balancing rings, which would add an evenly-distributed rotating mass on basket 122.

Still referring to FIG. 3, according to an exemplary embodiment, washing machine appliance 100 may further include one or more counterweights 166. For example, according to the illustrated embodiment, counterweights 166 are mounted to a front of the wash tub 120, both at the top and the bottom. However, according to alternative embodiments, any suitable number, size, and position of counterweights may be used. In general, counterweights 166 are configured for offsetting the weight of motor assembly 130, thereby moving the center of gravity of wash tub 120 closer to its longitudinal center. In this manner, the balance and stability of the wash tub 120 within cabinet 102 is improved.

Returning to FIGS. 1 and 2, in some embodiments, washing machine appliance 100 includes an additive dispenser or spout 170. For example, spout 170 may be in fluid communication with a water supply (not shown) in order to direct fluid (e.g., clean water) into wash tub 120. Spout 170 may also be in fluid communication with the sump 154. For example, pump assembly 156 may direct wash fluid disposed in sump 154 to spout 170 in order to circulate wash fluid in wash tub 120.

As illustrated, a detergent drawer 172 may be slidably mounted within front panel 140. Detergent drawer 172 receives a wash additive (e.g., detergent, fabric softener, bleach, or any other suitable liquid or powder) and directs the fluid additive to wash chamber 124 during operation of washing machine appliance 100. According to the illustrated embodiment, detergent drawer 172 may also be fluidly coupled to spout 170 to facilitate the complete and accurate dispensing of wash additive.

In optional embodiments, a bulk reservoir 174 is disposed within cabinet 102. Bulk reservoir 174 may be configured for receipt of fluid additive for use during operation of washing machine appliance 100. Moreover, bulk reservoir 174 may be sized such that a volume of fluid additive sufficient for a plurality or multitude of wash cycles of washing machine appliance 100 (e.g., five, ten, twenty, fifty, or any other suitable number of wash cycles) may fill bulk reservoir 174. Thus, for example, a user can fill bulk reservoir 174 with fluid additive and operate washing machine appliance 100 for a plurality of wash cycles without refilling bulk reservoir 174 with fluid additive. A reservoir pump 176 is configured for selective delivery of the fluid additive from bulk reservoir 174 to wash tub 120.

A control panel 180 including a plurality of input selectors 182 is coupled to front panel 140. Control panel 180 and input selectors 182 collectively form a user interface input for operator selection of machine cycles and features. A display 184 of control panel 180 indicates selected features, operation mode, a countdown timer, and/or other items of interest to appliance users regarding operation.

Operation of washing machine appliance 100 is controlled by a processing device or a controller 186 that is operatively coupled to control panel 180 for user manipulation to select washing machine cycles and features. In response to user manipulation of control panel 180, controller 186 operates the various components of washing machine appliance 100 to execute selected machine cycles and features. Controller 186 may include a memory and microprocessor, such as a general or special purpose microprocessor operable to execute programming instructions or micro-control code associated with methods described herein. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 186 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 180 and other components, such as measurement devices 190 and a balancing system 200 (described in more detail below) of washing machine appliance 100 may be in communication with controller 186 via one or more signal lines or shared communication busses to provide signals to and/or receive signals from the controller 186. Similar to the controller 186, the measurement devices 190 may include a microprocessor that performs the calculations specific to the measurement of motion with the calculation results being used by or communicated to the controller 186 and/or balancing system 200, as will be described in more detail below. According to exemplary embodiments, the at least one measurement device 190 may include a dedicated microprocessor that performs the calculations specific to the measurement of motion, such that the measurement device(s) 190 is/are operationally independent of the controller 186.

As illustrated for example in FIGS. 3 through 5 and 7, one or more measurement devices 190 may be provided in the washing machine appliance 100 for measuring movement of the tub 120, in particular during agitation of articles in the agitation phase of the wash cycle and/or during rotation of articles in the spin cycle of the washing operation. Measurement devices 190 may measure a variety of suitable variables that can be correlated to movement of the tub 120 and/or basket 122. The movement measured by such devices 190 can be utilized to, e.g., monitor the load balance state of the basket 122, determine various motion amplitudes, such as velocity, acceleration and/or displacement amplitudes of wash basket 122 at various locations, and to adjust operation of washing machine appliance 100 to prevent or mitigate effects of an out of balance load 1000 (e.g., FIG. 6) on washing machine appliance 100.

A measurement device 190 in accordance with the present disclosure may include an accelerometer which measures translational motion, such as acceleration along one or more directions. Additionally or alternatively, a measurement device 190 may include a gyroscope, which measures rotational motion, such as rotational velocity about an axis. Moreover, according to exemplary embodiments, a measurement device 190 may include more than one gyroscope and/or more than one accelerometer.

As will be described in greater detail below, movement may be measured as one or more displacement readings, e.g., certain displacement amplitudes A1, A2, and A3 (see FIG. 7), detected at the one or more measurement devices 190. Optionally, the amplitudes A1, A2, and A3 may occur in discrete channels of motion (e.g., as distinct directional components of movement). For instance, displacement amplitudes A1, A2, and A3 may correspond to one or more indirectly measured movement components perpendicular or approximately perpendicular to the shaft axis of the basket 122. Such movement components may, for example, occur in a plane defined by the lateral direction L and vertical direction V (FIG. 3), i.e., a lateral-vertical plane, or in a plane approximately parallel to the lateral-vertical plane. The plane in which the measured movement components occur may also be referred to herein as the measurement plane. Movement of the basket 122 along the particular direction may be calculated using the indirect measurement component and other suitable variables, such as a horizontal and/or radial offset distance along a vector from the measurement device 190 to the center of the tub 120. Additionally or alternatively, the displacement amplitudes A1, A2, and A3 may correspond to one or more directly measured movement components. Such movement components may, for example, occur in the lateral-vertical plane or in a plane approximately parallel to the lateral-vertical plane. Measurement devices 190 may measure a variety of suitable variables, which can be correlated to movement of the tub 120. The movement measured by such devices 190 can be utilized to monitor the load balance state of the basket 122 and/or tub 120 and to facilitate activation of a balancing system to adjust the load balance state, e.g., to provide a counterbalance to articles within the tub 120.

In exemplary embodiments, a measurement device 190 may include at least one gyroscope and/or at least one accelerometer. The measurement device 190, for example, may be a printed circuit board which includes the gyroscope and accelerometer thereon. The measurement device 190 may be mounted to the tub 120 (e.g., via a suitable mechanical fastener, adhesive, etc.) and may be oriented such that the various sub-components (e.g., the gyroscope and accelerometer) are oriented to measure movement along or about particular directions as discussed herein. Notably, the gyroscope and accelerometer in exemplary embodiments may be advantageously mounted at a single location on the tub 120 (e.g., the location of the printed circuit board or other component of the measurement device 190 on which the gyroscope and accelerometer are grouped). Such positioning at a single location advantageously reduces the costs and complexity (e.g., due to additional wiring, etc.) of out-of-balance detection, while still providing relatively accurate out-of-balance detection as discussed herein. Alternatively, however, the gyroscope and accelerometer need not be mounted on the tub 120 at a single location. For example, a gyroscope located at one location can measure the rotation of an accelerometer located at a different location, because rotation about a given axis is the same everywhere on a solid object such as tub 120.

In exemplary embodiments, during operation of washing machine appliance 100, laundry items are loaded into wash basket 122 through opening 142, and a wash operation is initiated through operator manipulation of input selectors 182. For example, a wash cycle may be initiated such that wash tub 120 is filled with water, detergent, or other fluid additives (e.g., via detergent drawer 172 or bulk reservoir 174). One or more valves (not shown) can be controlled by washing machine appliance 100 to provide for filling wash basket 122 to the appropriate level for the amount of articles being washed or rinsed. By way of example, once wash basket 122 is properly filled with fluid, the contents of wash basket 122 can be agitated (e.g., with ribs 126) for an agitation phase of laundry items in wash basket 122. During the agitation phase, the basket 122 may be motivated about the axis of rotation A at a set speed (e.g., first speed or tumble speed). As the basket 122 is rotated, articles within the basket 122 may be lifted and permitted to drop therein.

After the agitation phase of the washing operation is completed, wash tub 120 can be drained, e.g., by drain pump assembly 156. Laundry articles can then be rinsed (e.g., through a rinse cycle) by again adding fluid to wash tub 120, depending on the particulars of the cleaning cycle selected by a user. Ribs 126 may again provide agitation within wash basket 122. One or more spin cycles may also be used. In particular, a spin cycle may be applied after the wash cycle or after the rinse cycle in order to wring wash fluid from the articles being washed. During a spin cycle, basket 122 is rotated at relatively high speeds. For instance, basket 122 may be rotated at one set speed (e.g., second speed or pre-plaster speed) before being rotated at another set speed (e.g., third speed or plaster speed). As would be understood, the pre-plaster speed may be greater than the tumble speed and the plaster speed may be greater than the pre-plaster speed. Moreover, agitation or tumbling of articles may be reduced as basket 122 increases its rotational velocity such that the plaster speed maintains the articles at a generally fixed position relative to basket 122. After articles disposed in wash basket 122 are cleaned (or the washing operation otherwise ends), a user can remove the articles from wash basket 122 (e.g., by opening door 144 and reaching into wash basket 122 through opening 142).

Referring now specifically to FIG. 4, a schematic representation of a washing machine appliance and forces acting on the washing machine appliance during operation is illustrated. Specifically, continuing the example from above, the forces acting on wash tub 120 and wash basket 122 are illustrated. In this regard, wash tub 120 and wash basket 122 are illustrated as and may be referred to herein as a "suspended mass" of a front load washing machine appliance 100 wherein wash tub 120 supports wash basket 122 by drive shaft 132 and bearings 134, 136. In general, the methods described herein are intended to reduce the motion of the wash tub 120 at low speeds to avoid contact with the cabinet 102 and limit the forces acting on bearings 134, 136 at high speeds to prevent premature failure.

As shown in FIG. 4, out-of-balance force ($F_{OOB}$) acts on wash tub 120 proximate a front of wash tub 120 and has some amplitude. However, both the location and amplitude of the out-of-balance force is, in practice, unknown. Some washing machine appliances use sensor systems to estimate the location and amplitude of the out-of-balance force ($F_{OOB}$) and make appropriate corrections. However, the present method may be operable absent knowledge of the size or location of the unbalanced mass and thus the out-of-balance force ($F_{OOB}$).

For purposes of the present illustration, the suspended mass of washing machine appliance 100 is separated into parts convenient for the purpose of showing how the forces at the shaft bearings 134, 136 have the same magnitude at equilibrium whether they are acting on the rotating mass (i.e., wash basket 122) from one side of the bearings or on the non-rotating mass (i.e., wash tub 120) from the other side. The spinning out-of-balance mass has a centrifugal force ($F_{OOB}$) that causes the acceleration of all other suspended masses, e.g., wash tub 120 and wash basket 122, to reach equilibrium with the out-of-balance force ($F_{OOB}$). Thus, the masses undergoing acceleration produce a collective force equal to and opposite of the out-of-balance force ($F_{OOB}$). Specifically, as illustrated in FIG. 4, the out-of-balance force ($F_{OOB}$) is equal and opposite of the sum of the balancing force ($F_{BAL}$) and the external spring and damper forces (not shown). The external spring and damper forces are most significant at low speeds, whereas the magnitude of $F_{OOB}$ and $F_{BAL}$ are much greater relative to the external forces at higher speeds.

The calculated motion of the suspended mass, e.g., at the center of gravity (CG) thereof, which is calculated rather than directly measured (e.g., where there is no measurement device positioned at the CG), may be referred to herein as a "virtual point amplitude." In this regard, virtual point amplitudes are intended to refer to displacement or motion measurements at a location that does not include a measurement device. Virtual point amplitudes may generally be determined by estimation assuming wash tub 120 is a rigid body and knowing the dimensional configuration of wash tub 120. Notably, by using dimensional knowledge and making such assumptions, the position or motion of any point, including points away from the place where the measurement device is located, may be predicted based on the measured position or motion at the measured location. In this manner, washing machine appliance 100 need not include multiple measurement devices while still maintaining the motion of each point on wash tub 120. It should be appreciated that actual measured displacements or virtual point amplitudes or combinations thereof may be used according to various embodiments of the present subject matter.

Figure 5:
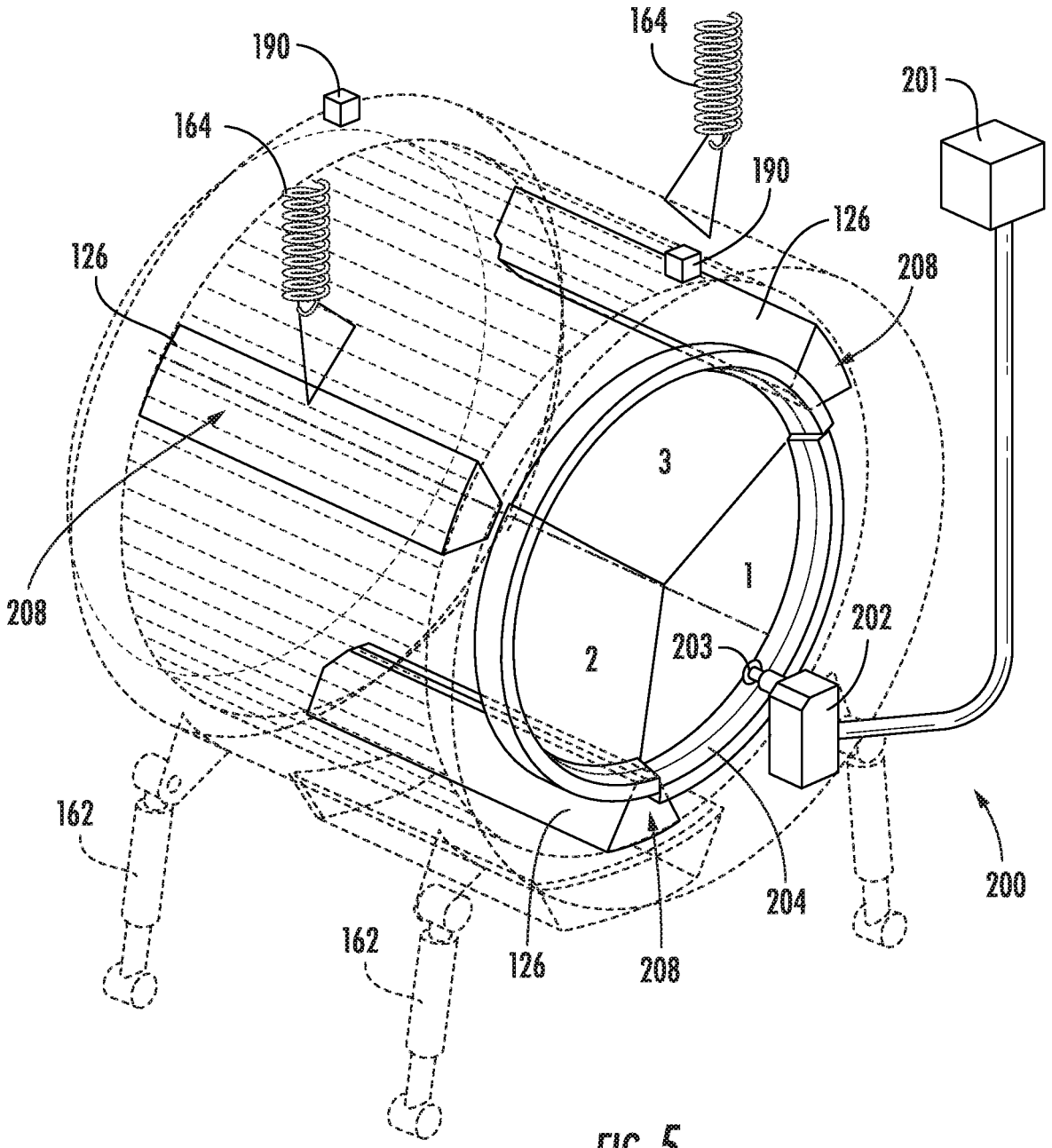
FIG. 5 provides a schematic representation of fill zones for an exemplary balancing system of a washing machine appliance according to example embodiments of the present subject matter.
Figure 6:
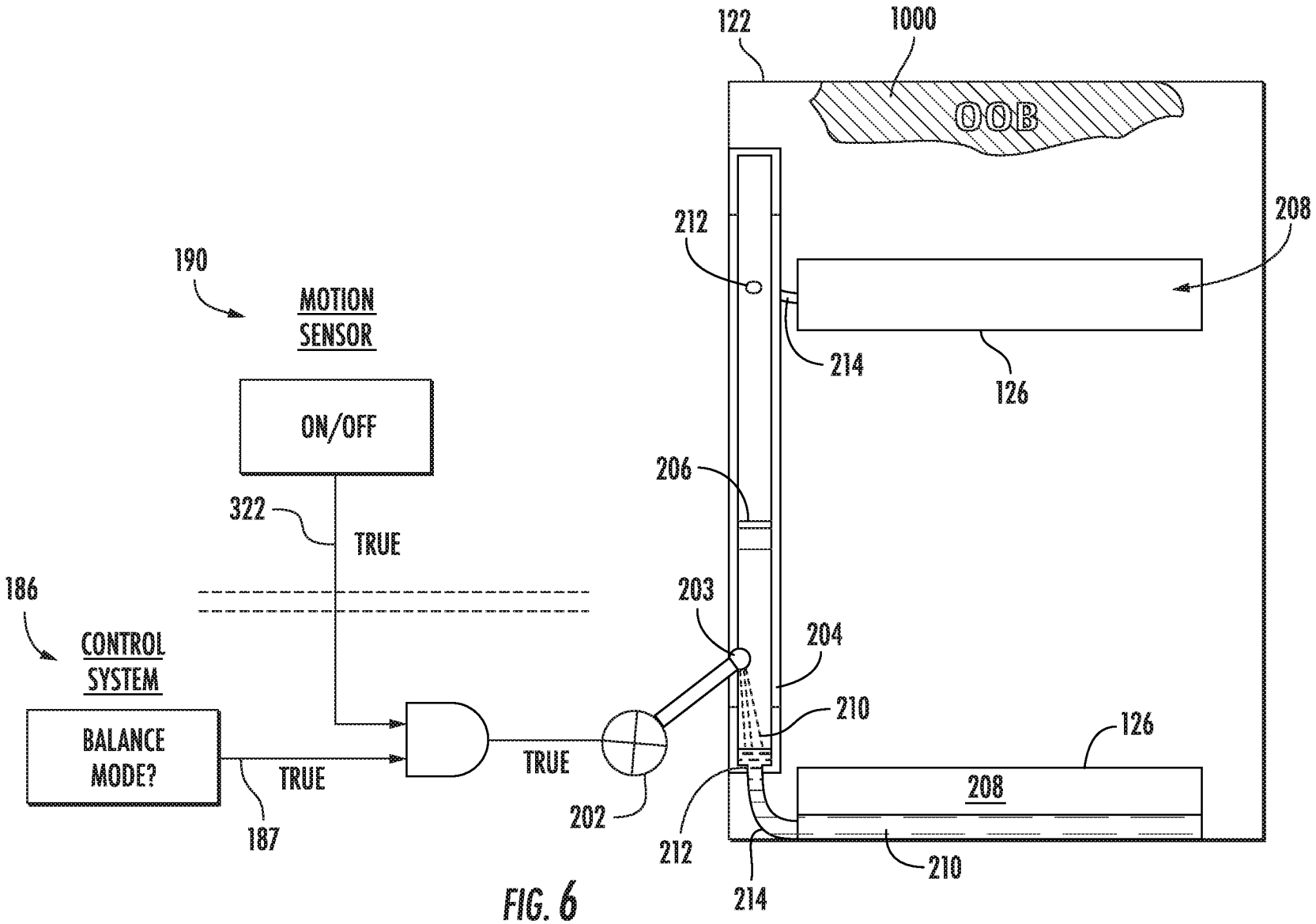
FIG. 6 schematically illustrates activation of a fill valve for an exemplary balancing system according to example embodiments of the present subject matter.

Turning now to FIG. 5, a balancing system 200 is illustrated. For sake of clarity of illustration as to the balancing system 200, other components of the washing machine appliance 100 are shown in dashed lines in FIG. 5. The balancing system 200 may include a control system 201, which may be a separate controller, e.g., including a memory and/or processor, similar to the controller 186 as described above, from the measurement devices 190, or may be integrated with the measurement devices 190. The balancing system 200 may also include a plurality of balance fluid chambers 208. For example, in the illustrated embodiment, the balancing system 200 includes three balance fluid chambers 208 defined within the ribs 126, e.g., the ribs 126 may be hollow and the interior of each hollow rib 126 may define a balance fluid chamber 208. A valve 202 of the balancing system 200 may be positioned upstream of a nozzle 203 to control a flow of balance fluid 210 (FIG. 6) through the nozzle 203, as will be understood by those of skill in the art. The balance fluid 210 may be, e.g., water. The nozzle 203 may be positioned for fluid communication with a gutter 204 to selectively fill one or more of the balance fluid chambers 208. For example, the nozzle 203 may be in fluid communication with the gutter 204 such that when the valve 202 is opened the balance fluid 210 may flow, e.g., spray, from the nozzle 203 into the gutter 204, e.g., as shown in FIG. 6. Accordingly, the balancing system 200 may define a plurality of fill zones corresponding to the plurality of balance fluid chambers 208. For example, where the illustrated embodiment includes three balance fluid chambers 208, the exemplary balancing system 200 illustrated in FIG. 5 defines three corresponding fill zones 1, 2, and 3. The fill zones 1, 2, and 3 are portions of the gutter 204 from which balance fluid 210 will flow into the corresponding balance fluid chamber 208 when the valve 202 is opened. Filling one or more of the balance fluid chambers 208 with balance fluid 210 may provide a counter balance to the out of balance ("OOB") load 1000 (FIG. 8), to avoid or reduce the imbalance of the spinning wash load 1000.

For example, FIG. 6 illustrates a relatively simple scenario where the OOB load 1000 is diametrically opposite one of the ribs 126 and the balance fluid chamber 208 therein. In such instances, the balancing system 200 may direct all of the fill into the balance fluid chamber 208 opposite the OOB load 1000. In other cases, where the OOB load 1000 is opposite a point between two balance fluid chambers 208, the balancing system 200 may direct part of the fill of balance fluid 210 into one of the fill zones 1, 2, or 3 and the remainder of the fill of balance fluid 210 into an adjacent one of the fill zones 1, 2, and 3. For example, the gutter 204 may include dams 206 which delineate the various fill zones 1, 2, and 3 from each other, e.g., such that balance fluid 210 flowing into the gutter 204 at one side of a dam 206 may be directed to the corresponding balance fluid chamber 208, e.g., via an aperture or port 212 and a conduit 214 extending from the port 212 in the gutter 204 to the balance fluid chamber 208 in the rib 126. The valve 202 and nozzle 203 provide a jet of balance fluid 210 during the portion of the rotation of basket 122 when balance fluid 210 added to the gutter 204 will drain into the balance fluid chamber(s) 208 opposite the imbalanced load 1000. The basket 122 speed during this operation is fast enough that centrifugal force keeps the balance fluid 210 in the gutter 204 and causes it to drain into the balance chamber(s) 208.

The valve 202 and the nozzle 203 are stationary relative to the rotatable basket 122, such that the spray or jet of balance fluid 210 from the nozzle 203 will flow into the portion of the gutter 204, e.g., one or more of the fill zones 1, 2, and 3, which traverses the nozzle 203 while the valve 202 is opened. Put simply for the sake of illustration but without limitation, the timing of when and for how long the valve 202 is opened while the basket 122 is rotating controls which balance fluid chamber(s) 208 receive the fill of balance fluid 210 and in what proportion. Thus, which one or more of the plurality of balance fluid chambers 208 receives the fill of balance fluid 210 is determined by the portion of the rotation of the basket 122 during which the valve 202 is opened. For example, as shown in FIGS. 5 and 6, where there are three balance fluid chambers 208 equally spaced around the circumference of the basket 122, each fill zone 1, 2, and 3 will correspond to an equal portion of the rotation of the basket 122, e.g., each fill zone 1, 2, and 3 will span an arc of 120°, or one-third of the 360° rotation of the basket 122.

In some embodiments of the present invention, the flow of the balance fluid 210 may be controlled by or in response to the measurement devices 190. For example, the measurement devices 190 may provide a simple binary signal, such as a TRUE/FALSE signal, for example, a high/low voltage at an output pin or a single bit in a serial digital transmission, to open and close the valve 202 of the balancing system 200.

Figure 7:
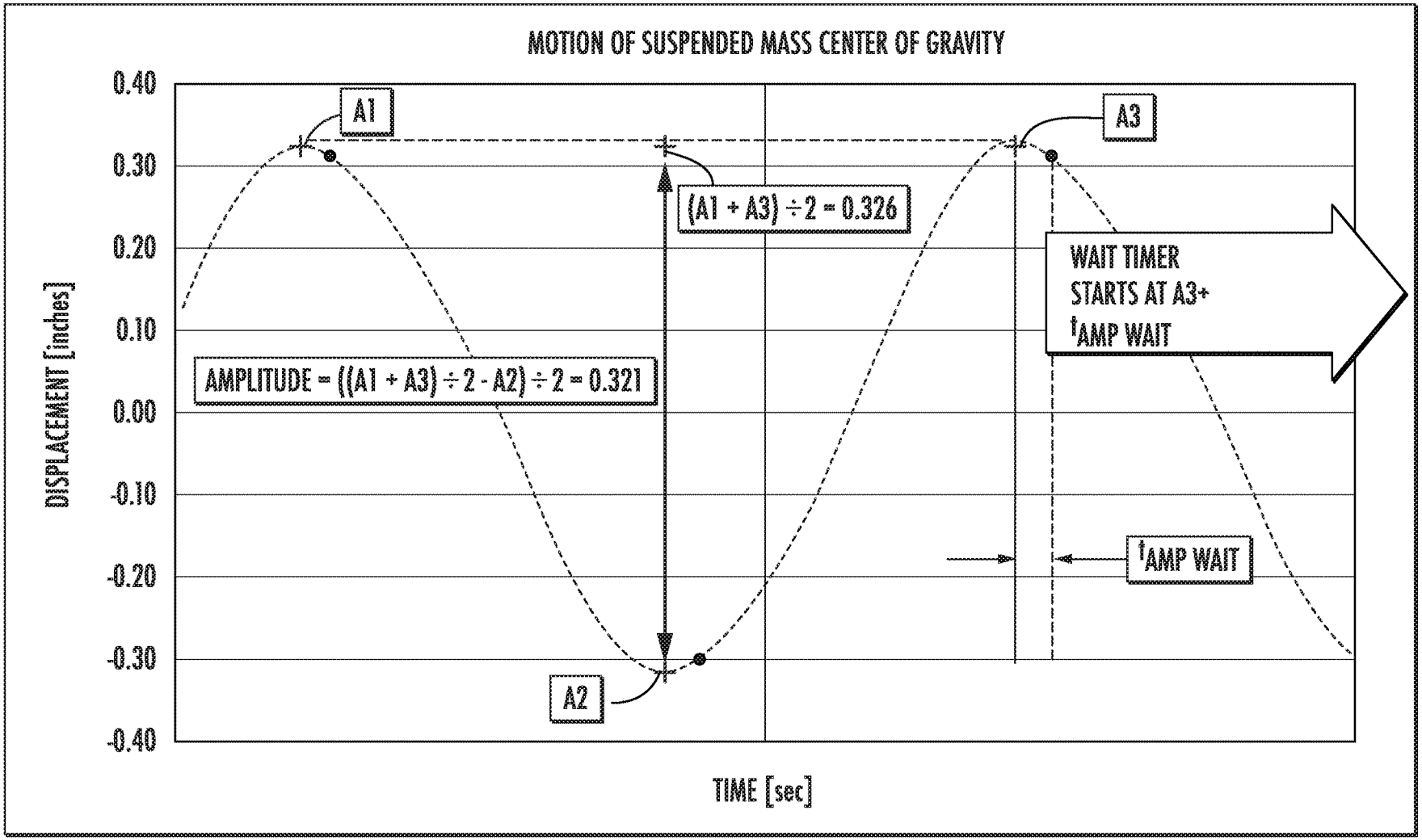
FIG. 7 provides a view of an exemplary measurement chart of detected displacements of tub movement in accordance with embodiments of the present disclosure.

In example embodiments, the one or more measurement devices 190 may measure or detect movement of the tub 120 as one or more displacement amplitudes using the accelerometer and a gyroscope. For example, the amplitudes A1, A2, and A3 may be measured and an average amplitude may be calculated as shown in FIG. 7. Such measurement may result in measured movements of the tub 120 being recorded, e.g., as discrete amplitudes A in one or more channels of motion, in a memory of the measurement device(s) 190. These measurements may be utilized to determine if the load of articles, and thus the basket 122 and tub 120, are out-of-balance. Accordingly, an out-of-balance movement threshold may be defined. For example, the out-of-balance movement threshold may be programmed into the sensor 190 as a threshold of one or more amplitudes. Measured movement above the threshold may indicate that the present load of articles is out-of-balance, while measured movement below the threshold may indicate sufficient balance of the load of articles. When movement of tub 120 exceeds the out-of-balance threshold, the motion sensor 190 may send a signal to the controller 186 and/or to the valve 202 of the balancing system 200.

In one particular (non-limiting) example, FIG. 7 illustrates the motion of the center of gravity of a horizontal axis washing machine (such as, for example, the washing machine appliance 100 illustrated in FIGS. 1-3, etc.) measured by a suitable measuring device 190 while basket 122 is rotating at one hundred revolutions per minute (RPM). The measurement device 190 amplitude calculation process has a delay before a new value is deemed to be a new peak, $t_{amp\ wait}$ (FIG. 7). The value of $t_{amp\ wait}$ is a fixed value during any particular step of a spin cycle. There is a wait time before opening the active balance fill valve 202, as will be explained in more detail below, that begins $t_{amp\ wait}$ seconds after the actual peak occurs and $t_{amp\ wait}$ will be factored into the calculation of the fill valve 202 wait time.

As mentioned above, before accelerating a wash load to the high speeds used for, e.g. a spin cycle, the controller 186 may maintain a constant speed of the basket 122, whereby the wash load is plastered. During this constant speed rotation, the effect of the imbalance 1000 on periodic motion may be measured using the amplitudes provided by the measurement device(s) 190. One of the amplitudes may be for a virtual point representing the motion at the center of gravity of the suspended mass.

Figure 9:
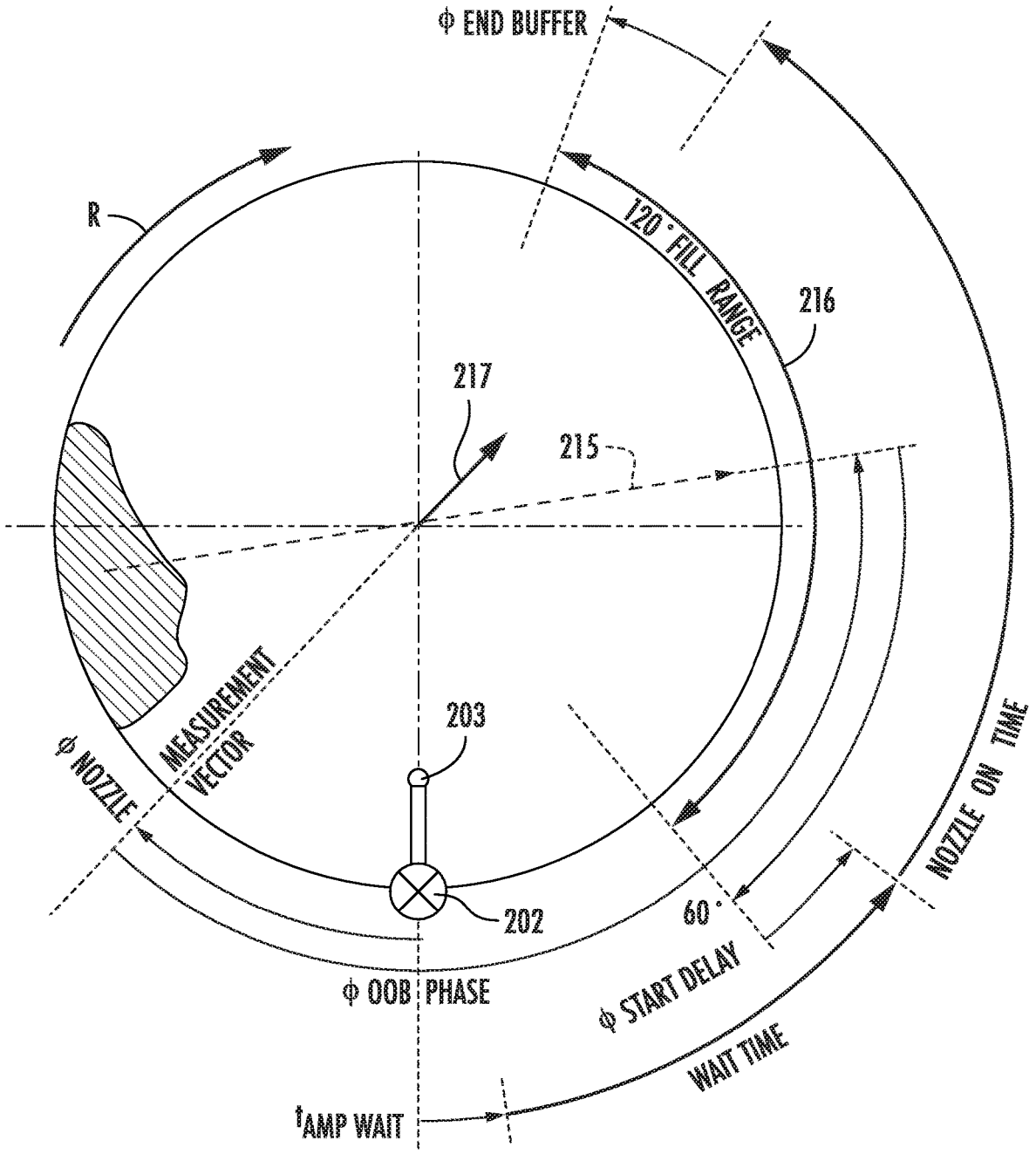
FIG. 9 schematically illustrates a wait time and a nozzle on time corresponding to an exemplary fill range for a balancing system according to example embodiments of the present subject matter.

The motion at the center of gravity of the suspended mass is used because the location of an imbalance 1000, whether it be located in the front, middle or rear of the basket 122, does not change the motion amplitude of the center of gravity very much. This relationship becomes increasingly strong as speed increases. At low speeds, the point least affected by the imbalance location may move, e.g. forward of the center of gravity CG because the external forces applied by springs, gaskets and dampers have more influence. Referring to FIG. 9, when the measurement device 190 calculates virtual points, the direction of the measurement is illustrated by vector 217 that lays in a measurement plane. The angle between the measurement vector 217 and the fixed location of the nozzle 202 can be modified for different speeds if it advantageous, e.g., if it increases the accuracy or reliability of the relationship between imbalance mass and amplitude. Alternatively, the control system 201 of the balancing system 200 can adapt to the changed in relative angles at different speeds, e.g., as will be explained in more detail in the context of an exemplary method below. For the purpose of controlling the timing of the fill valve 202, a single measurement device 190 located near or at the center of gravity may be sufficient. In other embodiments, more than one measurement device 190 may be provided.

The process of active balancing will be performed while the basket 122 is spinning at a constant speed. At a given speed, the time it takes the basket 122 to complete one revolution is constant. The time to rotate is $t_{PERIOD}$, or $t_P$.

$$t_P = 60/\text{speed}_{rpm}[\text{seconds}]$$

Figure 8:
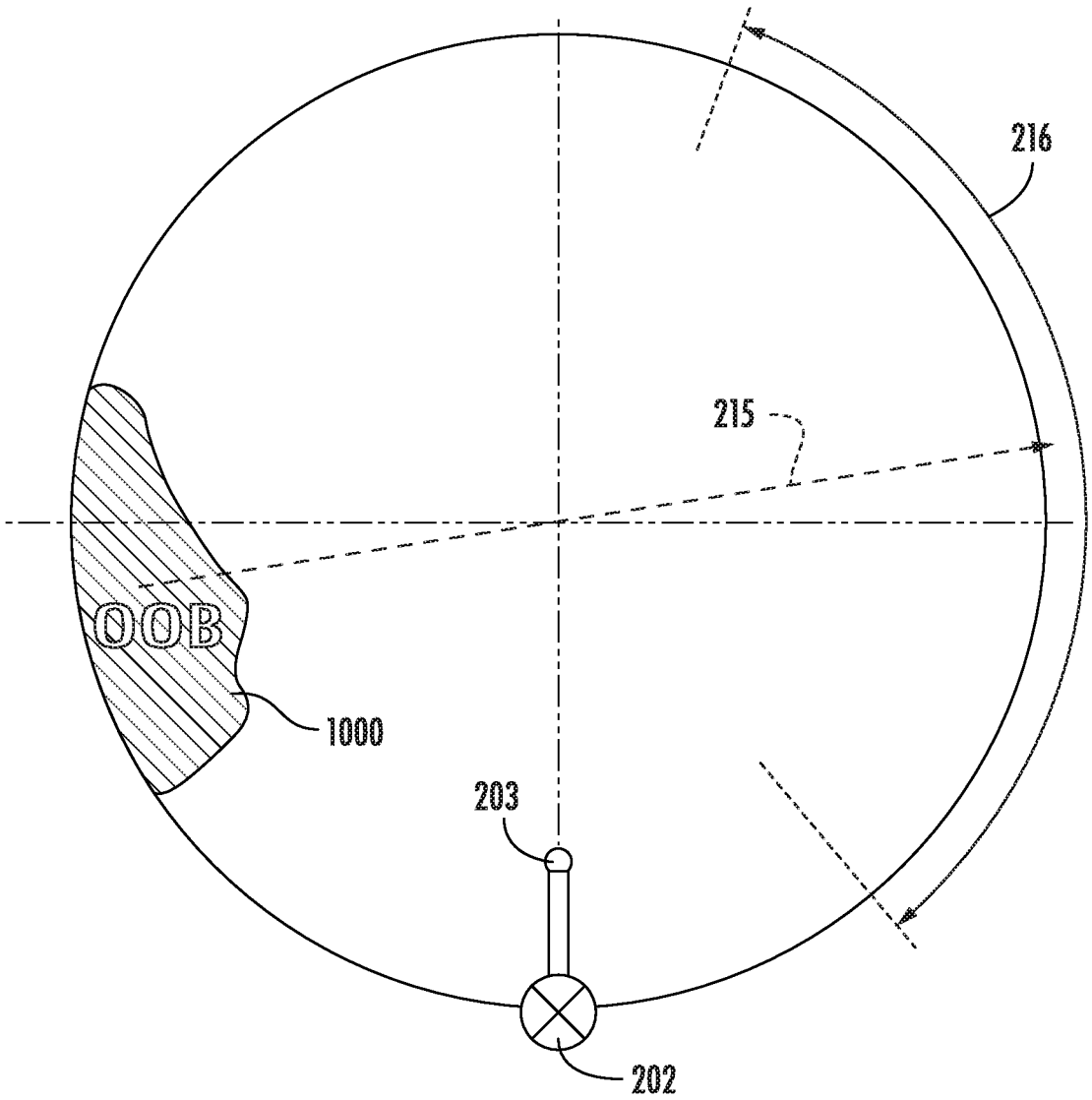
FIG. 8 schematically illustrates a target fill range for an exemplary balancing system according to example embodiments of the present subject matter.

Turning now to FIGS. 8 and 9, in order to counterbalance an OOB load 1000 located anywhere around the circumference of the basket 122, there may preferably be at least three fluid chambers 208 (e.g., FIG. 6) that can be filled to add mass opposite the OOB load 1000. If there are three chambers 208, there is a target fill range 216 opposite the OOB load 1000, e.g., centered on the intersection of line 215 with the edge of the basket, where line 215 extends through the center of mass of the OOB load 1000 and the center of the basket 122. Line 215 is in the same measurement plane as measurement vector 217 (FIG. 9). As illustrated in FIG. 9, the target fill range 216 may, in some embodiments, comprise an arc sweeping one third of a full rotation, 120°. The time it will take this arc to rotate past the fill nozzle is the ideal length of time the valve will be open, $t_{FILL\ IDEAL}$. For example, in embodiments where three balance fluid chambers 208 are provided, $t_{FILL\ IDEAL}$ may be calculated as follows:

$$t_{FILL\ IDEAL} = t_P 120°/360° = t_P/3$$

As the speed of the basket 122 increases, the phase angle between the location of the maximum displacement of the basket 122 and the OOB load 1000 increases. At very low speeds, the OOB load 1000 and the maximum displacement are nearly in the same location and the phase angle approaches 0°. At very high speeds, such as above 800 RPM, the maximum displacement and the OOB load 1000 are opposite each other and the phase angle approaches 180°. For a given washing machine, this phase angle is a known function of, primarily, the speed and the direction the amplitude is measured in. The size of the wash load can have a smaller effect on the phase angle. The time it takes the basket to rotate through the phase angle, $t_{PHASE}$, will be used in the calculation that determines when the nozzle 203 is aligned with the ideal fill range:

$$t_{PHASE} = t_P(\phi\text{OOB PHASE}/360)$$

The process of turning the fill valve 202 on may be delayed by some amount for a number of reasons such as to account for error, to prevent over filling the gutter 204, or to provide finer control over the amount of balance fluid 210 added in one rotation of the basket 122. The delay time begins when the nozzle 203 is approximately aligned with the 120° fill range 216 and may be denoted by the speed dependent constant $t_{START\ DELAY}$. It should be noted that the 120° fill range 216 is by way of example only, in other embodiments more than three balance fluid chambers 208 may be provided, in such embodiments the fill range 216 may be less than 120°, e.g., for four balance chambers 208, the fill range 216 may be about 90°, etc.

The contributions to the calculation of the end buffer angle or time $t_{END\ BUFFER}$ may be similar to $t_{START\ DELAY}$, but there is an additional constraint on the value of $t_{END\ BUFFER}$. The arc of rotation for the time the valve 202 is on should be centered on the point directly opposite the OOB load 1000. As mentioned above, the gutter 204 is divided into parts, e.g., by dams 206, such that each part drains into a corresponding one of the plurality of balance fluid chambers 208 so that two chambers 208 can receive fluid 210 during the balancing. If the portion of the gutter 204 corresponding to one chamber 208 (e.g., one of the fill zones 1, 2, and 3 illustrated in FIG. 5) spans a greater proportion of the fill range than the fill zone 1, 2, or 3 corresponding to the other chamber 208, centering the nozzle 203 on-time so that the midpoint of the flow from the nozzle 203 is opposite the OOB load 1000 will proportion the balance fluid 210 between the two fluid chambers 208 so that the net mass of balance fluid 210 added is opposite the OOB load 1000.

To calculate the nozzle on-time, $t_{ON}$, so that it is centered opposite the OOB mass:

$$t_{ON}=t_{FILL\ IDEAL}-2*t_{START\ DELAY}$$

where $t_{END\ BUFFER}=t_{START\ DELAY}$.

Once the value of $t_{START\ DELAY}$ is established the value of $t_{WAIT}$ can be calculated. The effect of the angle $\phi_{NOZZLE}$ between the vector used to measure the amplitude (e.g., the measurement vector 217, as described above) and the location of the nozzle 203 is also needed and is represented by the speed dependent constant $t_{NOZZLE}$.

$$t_{NOZZLE}=t_P(\phi NOZZLE/360)$$

The next term accounts for the angle between the middle of the fill arc 216 and its ends. For example, in the illustrated embodiments where the fill arc 216 extends across 120°, the angle between the middle of the fill arc 216 and the ends thereof will be 60° (see, e.g., FIG. 9), such that this term may be referred to as $t_{60}$:

$$t_{60}=t_P(60/360)$$

Using FIG. 9 to define the sign of each term (e.g., relative to the direction of rotation R of the basket 122), $t_{WAIT}$ is calculated as:

$$t_{WAIT}=t_{PHASE}-t_{NOZZLE}-t_{60}+t_{START\ DELAY}-t_{AMP\ WAIT}$$

In some embodiments, only the values of $t_{WAIT}$ and $t_{ON}$ may be stored on the measurement device 190 to control the valve 202. Such embodiments may advantageously minimize the memory requirements for the control system 201, in particular for the measurement device 190. In some embodiments, e.g., when balancing is only performed at one speed, the values of $t_{WAIT}$ and $t_{ON}$ may be stored as individual constants. In other embodiments, the values may be stored in a table when balancing is done at different speeds. In some embodiments, $t_{WAIT}$ and $t_{ON}$ may not be stored as a value representing units of time, i.e. seconds. In such embodiments, the stored values may instead be proportional to the time they represent, e.g., $t_{WAIT}$ and $t_{ON}$ may be integers scaled according to the clock rate used by the measurement device 190 microprocessor to perform the task of measuring $t_{WAIT}$ and $t_{ON}$.

As mentioned above, the measurement device 190 may be operationally independent of the controller 186. For example, in some embodiments, the controller 186 may not require a signal from the measurement device 190 to control the fill nozzle 202 signal 187. The controller 186 will continue to use the previously defined amplitude data from the measurement device 190 to additionally determine if active balancing should take place. Similarly, the measurement device 190 may not require a signal from the controller 186 to determine when to turn the fill nozzle 202 on and off. The measurement device 190 may be configured by the controller 186 prior to the fluid balancing operation.

Returning to FIG. 6, the capability to control the balancing process using the washing machine's controller 186 and the measurement device 190 operating independently is illustrated by the exemplary AND gate logic depicted in FIG. 6. The AND gate shown in FIG. 6 is provided by way of example only, there are several means of implementing the AND function according to various embodiments of the present disclosure, including relays, discrete transistors, or software to control the power supplied to the fill valve 202. As another example, the AND function could be implemented with an actuator, such as a solenoid, which requires two signals, e.g., two voltages, in order to open the valve 202. Also as shown in FIG. 6, the controller 186 of washing machine 100 provides an independent control signal 187 that may remain in the TRUE state regardless of the rotation angle of the basket 122. The need for performing the balance operation is determined using the above-described features of the measurement device 190. In at least some embodiments, the controller 186 may independently determine if the amplitude (e.g., the average amplitude as shown in FIG. 7) is large enough to require balancing. If the imbalance becomes small enough during the active balance system operation, the controller 186 may independently change its fill control signal to the FALSE state. The measurement device 190 may be programmed to remain in the FALSE state below some threshold stored in its permanent memory of the displacement amplitude of the preferred point of measurement, e.g. center of gravity, where the threshold indicates the measured motion is too small to be reliable or does not require the action of the active balance system 200. The valve 202 feeding fluid 210 to the fill nozzle 203 is only turned on if both the measurement device 190 and controller 186 signals 322 and 187 are TRUE.

Turning now to FIGS. 10-14, embodiments of the present disclosure may include a method 300. As will be described below in more detail in the context of a particular exemplary embodiment, the method 300 may include two sequential time measurements based on constants ($t_{ON}$ and $t_{WAIT}$) stored permanently in a program memory, such as a memory of the measurement device 190. In the illustrated exemplary embodiment, the measurement device 190 is a motion sensor, which may include, e.g., a gyroscope and/or an accelerometer, as described above. In some embodiments, the process of measuring the sequence of two time periods begins when software of the measurement device 190 determines that a new displacement amplitude of a designated sign, either positive or negative, has occurred.

Figure 10:
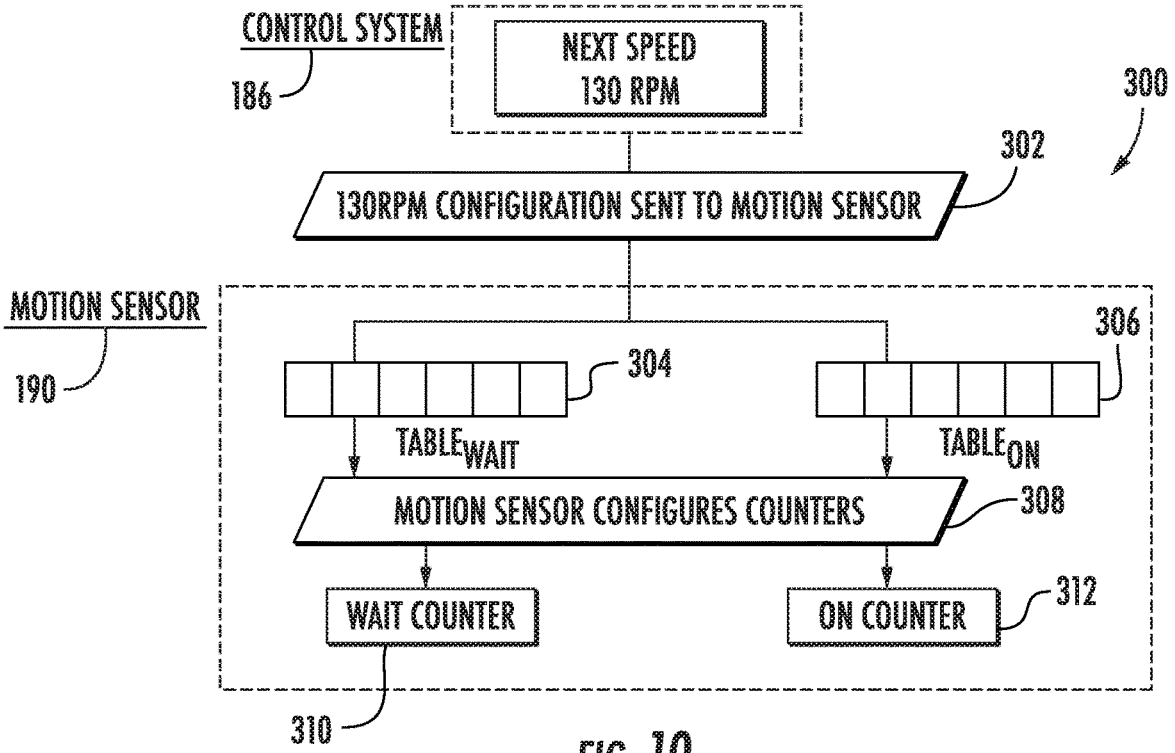
FIG. 10 illustrates exemplary steps for setting counters or timers in an exemplary method of operating a washing machine appliance according to example embodiments of the present subject matter.

As illustrated in FIG. 10, the controller 186 may send configuration data 302 to the measurement device 190 at the beginning of each step in the sequence comprising a spin cycle, e.g., indicating the rotational speed for the step in the sequence. For example, the indicated rotational speed may be 130 RPM as illustrated in the exemplary embodiment of FIG. 10. In other embodiments, the indicated rotational speed may be any suitable speed as may be employed in operating a washing machine appliance, as will be understood by those of skill in the art. In accordance with the present disclosure, the configuration file 302 may include an instruction that instructs the measurement device 190 to load the appropriate values of $t_{WAIT}$ and $t_{ON}$ for the indicated rotational speed during a subsequent active balancing operation. For example, as illustrated in FIG. 10, the value of $t_{WAIT}$ may be determined from a lookup table $table_{WAIT}$ 304 and the value of $t_{ON}$ may be determined from a lookup table $table_{ON}$ 306. For example, the stored values may be scaled integers, as described above. After obtaining the values of $t_{WAIT}$ and $t_{ON}$ from the lookup tables 304 and 306, the measurement device 190 may configure counters at step 308. The output of the configuring step 308 may include a WAIT counter 310 and an ON counter 312. Alternatively, tables 304 and 306 may be stored in the controller or the speed dependent values may be calculated as needed using the relationships defined by the preceding paragraphs.

Figure 11:
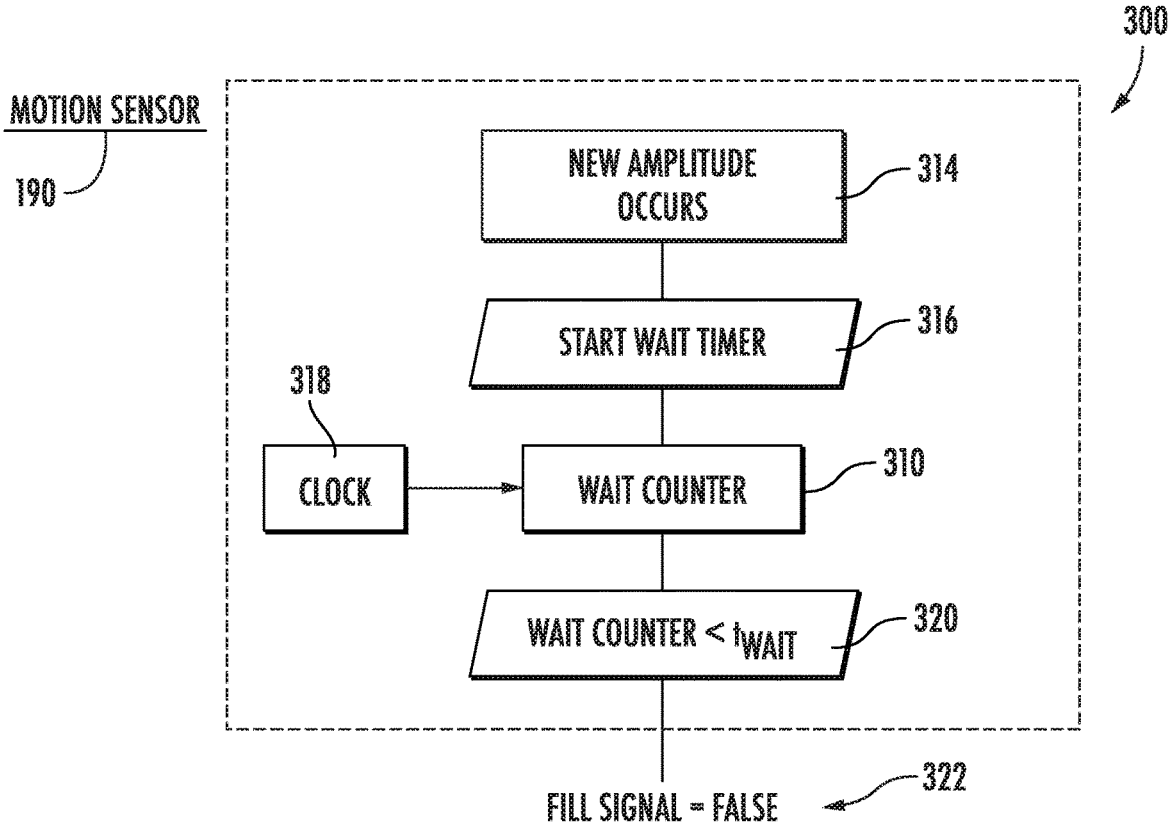
FIG. 11 illustrates exemplary steps of an exemplary method of operating a washing machine appliance according to example embodiments of the present subject matter.

Turning now to FIG. 11, the occurrence of a new amplitude at step 314, (the amplitude may be, e.g., an average amplitude which is calculated as illustrated in FIG. 7), starts the process of measuring $t_{WAIT}$ at step 316. The process of measuring $t_{WAIT}$ may be done by the measurement device 190 microprocessor using software or an on-board hardware timer. Simplistically, measuring $t_{WAIT}$ involves counting the cycles of a reference clock 318 (for example, the reference clock 318 may be built into the microprocessor of the measurement device 190) and outputting the cycles of the reference clock 318 to the wait counter 310. It is generally understood the clock 318 may include any source of alternating rising and falling edges that occur at a fixed rate. As illustrated in FIG. 11, when the wait counter 310 is less than the value of $t_{WAIT}$ (e.g., the value obtained from table$_{WAIT}$ 304 in FIG. 12) at step 320, the measurement device 190 will output a fill signal 322 of FALSE. The measurement device 190 will continue counting the cycles of the reference clock 318 until the number of cycles counted, e.g., the wait counter 310, is equal to the value representing $t_{WAIT}$. The sign of the amplitude used to trigger the start of measuring $t_{WAIT}$ at 314 can be either positive or negative as long as only one of the two is used and the calculation of $t_{WAIT}$ accounts for which sign is selected. As illustrated in FIG. 11, the measurement device 190 fill signal 322 is set to its FALSE state before and during the $t_{WAIT}$ measurement.

Figure 12:
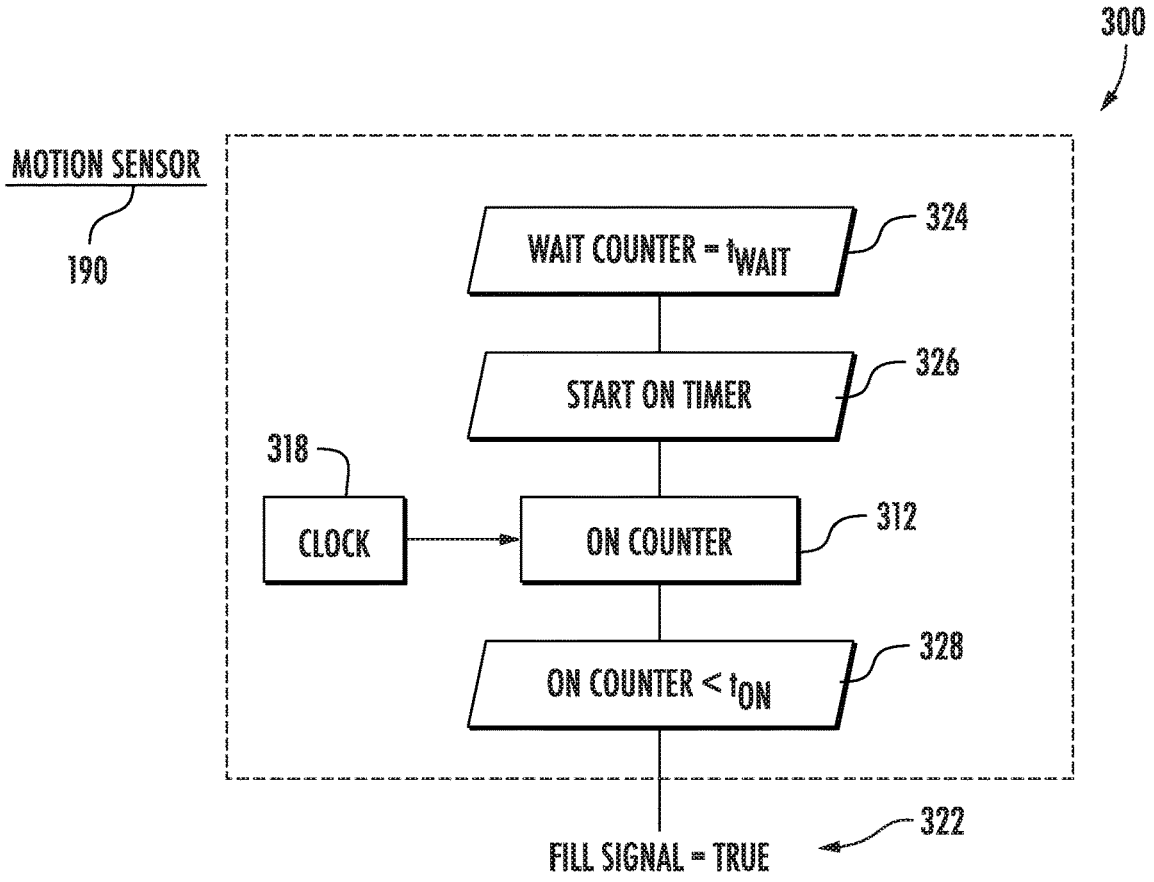
FIG. 12 illustrates additional exemplary steps of the exemplary method of FIG. 11.

Turning now to FIG. 12, when the wait counter reaches $t_{WAIT}$ at 324, the measurement of $t_{WAIT}$ is complete. At that point, the fill signal 322 is set to the TRUE state and the measurement of $t_{ON}$ is started at 326. As shown in FIG. 12 and similar to the measurement of $t_{WAIT}$, the measurement of $t_{ON}$ may include counting cycles of the reference clock 318 and adding the cycles to the ON counter 312. When the ON counter is less than $t_{ON}$ at 328, the fill signal 322 is set to TRUE.

Figure 13:
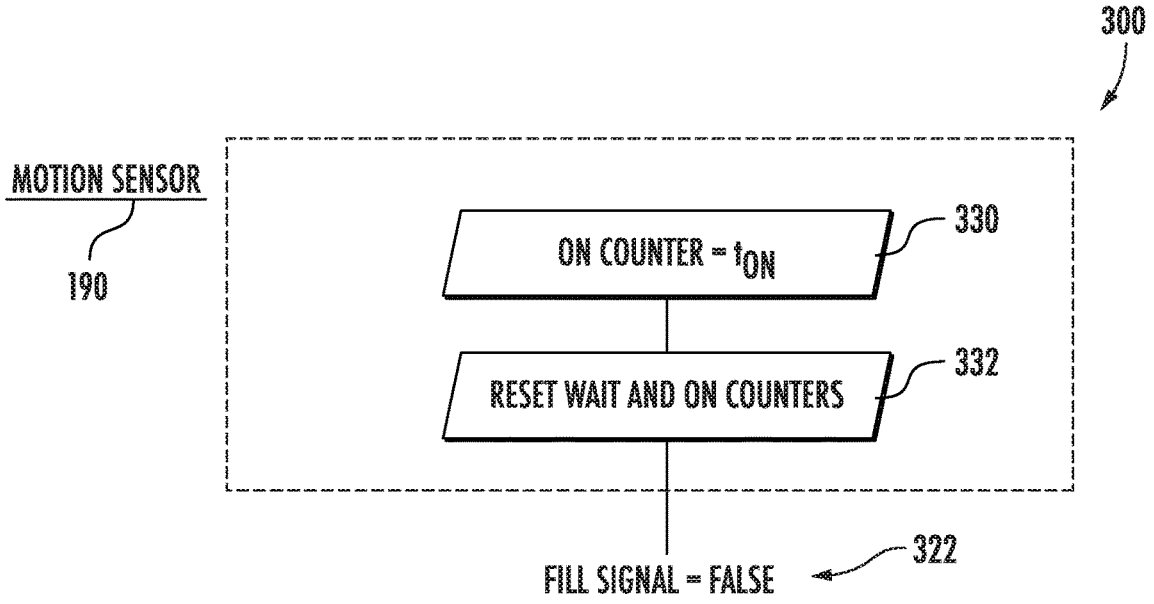
FIG. 13 illustrates additional exemplary steps of the exemplary method of FIG. 11.

After $t_{ON}$ has elapsed, e.g., when the ON counter reaches $t_{ON}$ as illustrated for example at 330 in FIG. 13, the fill signal 322 is set to the FALSE state and the software or hardware timers that measure $t_{WAIT}$ and $t_{ON}$ may be zeroed, or reset, at step 332 to prepare for the next measurement cycle.

As mentioned above, the process of measuring the sequence of two time periods begins when software of the measurement device 190 determines that a new displacement amplitude of a designated sign, either positive or negative, has occurred. In some embodiments, the amplitude measures the periodic radial motion of the approximate center of gravity of the suspended mass of the washing machine appliance calculated using a virtual point, e.g., a virtual point amplitude, as described above. In other embodiments, the displacement amplitude may be directly measured, e.g., when the measurement device 190 is located approximately near the center of gravity. In at least some embodiments, the measurement device 190 only activates the valve 202 of the balancing system 200, e.g., provides an external TRUE signal 322, while the measurement device 190 is performing the measurement of the second time period $t_{ON}$. Additionally, the measurement device 190 TRUE signal may coincide with an orientation of the spinning wash basket that causes the fill nozzle 203 of the balancing system 200 to deliver balance fluid 210 to one or more selected balance fluid chambers 208 over an arc centered opposite the unbalanced wash load 1000 in the basket 122. For example, the measurement device 190 sends an external signal 322 in the TRUE state for a rotation angle of 120° or less if there are three balancing fluid chambers 208. In other embodiments, e.g., when there are four equally spaced balancing fluid chambers 208, the external signal 322 remains in the TRUE state for a rotation angle of 90° or less.

Figure 14:
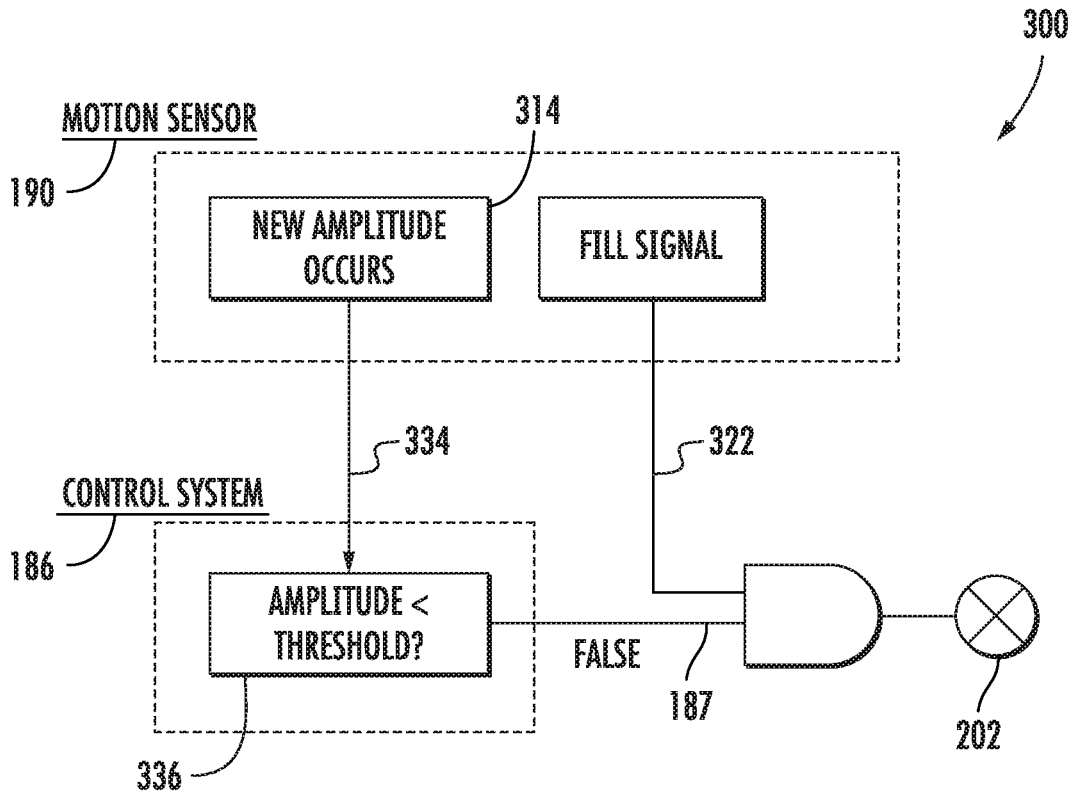
FIG. 14 illustrates additional exemplary steps of the exemplary method of FIG. 11.

In some embodiments, the method 300 may also include a decision to stop filling. For example, as illustrated in FIG. 14, at each occurrence of a new amplitude 314 measured by the measurement device 190, the measurement device 190 may send a signal 334 indicative of a magnitude of the measured amplitude. In such embodiments, the method 300 may then include a step 336 of comparing the measured amplitude 314 to a threshold, such as an out-of-balance movement threshold, as described above, and determining whether the measured amplitude is less than the threshold. A motion amplitude less than the threshold may indicate a sufficient mass of the balancing fluid 210 has been provided to counter-balance the OOB load 1000, as such, when the motion amplitude is less than the threshold at step 336, the control signal 187 is set to FALSE. Where the fill valve 202 is controlled by an AND logic, e.g., an AND gate as described above with reference to FIG. 6, setting the control signal 187 to FALSE will close the fill valve 202 and stop filling the balance fluid chambers 208.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for operating a washing machine appliance, the washing machine appliance having a wash tub, a wash basket rotatably mounted within the wash tub, and a balancing system comprising a plurality of fluid chambers defined in the wash basket, the method comprising:

rotating the wash basket within the wash tub at a basket speed;

receiving, with the balancing system, a first signal from a measurement device;

receiving, with the balancing system, a second signal from a controller of the washing machine appliance;

determining at least one time-based constant based on the basket speed, the at least one time-based constant comprising a fill nozzle wait time and a fill nozzle on time; and opening a valve to provide fluid to at least one of the plurality of fluid chambers of the balancing system based on the first signal and the second signal.

2. The method of claim 1, wherein the first signal is a TRUE/FALSE signal, the second signal is a TRUE/FALSE signal, and wherein the step of opening the valve is performed when the first signal and the second signal are both TRUE.

3. The method of claim 1, wherein the measurement device measures a motion amplitude of the wash tub and sends the signal to the balancing system based on the measured amplitude.

4. The method of claim 1, wherein the fill nozzle wait time is based on a phase angle between a load in the wash basket and a location of maximum displacement of the wash basket.

5. The method of claim 1, wherein the fill nozzle wait time is based on an angle between a measurement vector and the location of the fill nozzle of the balancing system.

6. The method of claim 1, wherein the fill nozzle wait time is based on an arc angle between adjacent ones of the plurality of fluid chambers.

7. The method of claim 1, wherein the measurement device measures a motion amplitude and wherein determining at least one time-based constant comprises determining a new value of the fill nozzle wait time at each occurrence of a new motion amplitude measured by the measurement device.

8. The method of claim 1, wherein the step of opening the valve comprises providing fluid to two of the plurality of fluid chambers of the balancing system.

9. A washing machine appliance comprising:

a cabinet;

a wash tub positioned within the cabinet;

a wash basket rotatably mounted within the wash tub;

a measurement device configured for sending a first signal to a balancing system of the washing machine appliance; and a controller, the controller configured for:

rotating the wash basket within the wash tub at a basket speed; and sending a second signal to the balancing system of the washing machine appliance;

wherein the balancing system is configured for determining at least one time-based constant based on the basket speed, the at least one time-based constant comprising a fill nozzle wait time and a fill nozzle on time, and for opening a valve to provide fluid to at least one of a plurality of fluid chambers of the balancing system based on the first signal and the second signal.

10. The washing machine appliance of claim 9, wherein the first signal is a TRUE/FALSE signal, the second signal is a TRUE/FALSE signal, and wherein the balancing system is configured for opening the valve when the first signal and the second signal are both TRUE.

11. The washing machine appliance of claim 9, wherein the measurement device is further configured for measuring a motion amplitude of the wash tub and for sending the signal to the balancing system based on the measured amplitude.

12. The washing machine appliance of claim 9, wherein the fill nozzle wait time is based on a phase angle between a load in the wash basket and a location of maximum displacement of the wash basket.

13. The washing machine appliance of claim 9, wherein the fill nozzle wait time is based on an angle between a measurement vector and the location of the fill nozzle of the balancing system.

14. The washing machine appliance of claim 9, wherein the fill nozzle wait time is based on an arc angle between adjacent ones of the plurality of fluid chambers.

15. The washing machine appliance of claim 9, wherein the measurement device is further configured for measuring a motion amplitude and the at least one time-based constant comprises a new value of the fill nozzle wait time determined at each occurrence of a new motion amplitude measured by the measurement device.

16. The washing machine appliance of claim 9, wherein the balancing system is configured for opening the valve to provide fluid to two of the plurality of fluid chambers of the balancing system.

* * * * *